US012365022B1

(12) United States Patent
Spangler

(10) Patent No.: US 12,365,022 B1
(45) Date of Patent: Jul. 22, 2025

(54) CORE FIRING SETTER

(71) Applicant: RTX Corporation, Farmington, CT (US)

(72) Inventor: Brandon W. Spangler, Vernon, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/750,227

(22) Filed: Jun. 21, 2024

(51) Int. Cl.
*B22C 9/10* (2006.01)
*B22C 7/02* (2006.01)
*B22C 9/12* (2006.01)

(52) U.S. Cl.
CPC ..... *B22C 9/10* (2013.01); *B22C 7/02* (2013.01); *B22C 9/12* (2013.01)

(58) Field of Classification Search
CPC .. B22C 9/10; B22C 9/12; B22C 9/108; B22C 7/02; B22C 21/14
See application file for complete search history.

(56) References Cited

U.S. PATENT DOCUMENTS

| | | | | |
|---|---|---|---|---|
| 5,465,780 | A * | 11/1995 | Muntner | B28B 11/12 164/369 |
| 10,300,526 | B2 | 5/2019 | Propheter-Hinckley et al. | |
| 10,378,364 | B2 | 8/2019 | Spangler et al. | |
| 10,596,621 | B1 * | 3/2020 | Marcin | B22F 5/007 |
| 10,598,438 | B2 * | 3/2020 | Balaschak | F27D 5/00 |
| 11,014,140 | B2 | 5/2021 | Banks et al. | |
| 11,459,897 | B2 | 10/2022 | Spangler et al. | |
| 11,629,602 | B2 | 4/2023 | Spangler et al. | |
| 11,945,025 | B1 | 4/2024 | Breneman et al. | |
| 2009/0224441 | A1 * | 9/2009 | Dodds | F27D 3/0021 264/607 |
| 2011/0132564 | A1 | 6/2011 | Merrill et al. | |
| 2018/0135430 | A1 * | 5/2018 | Weber | B22C 21/14 |
| 2024/0102391 | A1 | 3/2024 | Spangler et al. | |

* cited by examiner

*Primary Examiner* — Kevin P Kerns
*Assistant Examiner* — Steven S Ha
(74) *Attorney, Agent, or Firm* — Bachman & LaPointe, P.C.

(57) ABSTRACT

A method for firing a ceramic core includes: placing the core in a setter, the setter having a plurality of protruding setter posts between second legs of the core and with distal ends supporting first legs of the core; and firing the core in the setter to harden the core. During the firing, the setter posts maintain a predetermined minimum separation between the first legs and the second legs.

20 Claims, 9 Drawing Sheets

CORE FIRING SETTER

BACKGROUND

The disclosure relates to gas turbine engines. More particularly, the disclosure relates to setters for holding ceramic cores during core firing.

Gas turbine engines (used in propulsion and power applications and broadly inclusive of turbojets, turboprops, turbofans, turboshafts, industrial gas turbines, and the like) include components cast over ceramic cores. Particular notable components are airfoil elements (e.g., blades and vanes) wherein the ceramic cores cast cooling passageways through the airfoil (and from inlets typically in the inner diameter (ID) end of a root or in a shroud or platform of a vane).

Ceramic cores are typically molded from a ceramic slurry or paste to form a "green" core. Prior to casting, the green core must be further hardened in a core firing stage. The firing is performed using a core setter (e.g., a pre-fired ceramic that receives the green core and has a complementary curvature). For example, the setter may have an upward-facing concavity generally complementary to the convexity of an airfoil suction side and the green core may be placed with its suction side facing down and contacting the concavity. Thus, for example, the shape of the setter concavity may generally correspond to the interior of a suction side wall rather than the exterior (e.g., thus having slightly tighter radii of curvature).

Some setters mate a top half to such a bottom half in order to hold the core down during firing and otherwise prevent movement. Alternatively, some core firing processes use a media such as ceramic beads to hold the core down in a setter lower half (absent an upper half).

However, so-called multi-wall castings may have cores with multiple sections of a single core piece stacked between the pressure side and suction side of the airfoil. Such a single core piece may represent the entirety of a core or may represent one piece having multiple layers which, in turn, is mated with one or more additional pieces adding one or more additional layers.

Firing core assemblies for casting multiple groups of passageways presents issues of maintaining relative spacing of associated core segments during firing. For example, the core assembly may have many separate pieces. One example involves a leading main body piece, a trailing main body piece, a suction side piece, and a pressure side piece. The positioning of such cores relative to each other creates stacked tolerance issues at multiple stages of the casting process increasing variability of aspects such as wall thickness.

SUMMARY

One aspect of the disclosure involves a method for firing a ceramic core, the method comprising: placing the core in a setter, the setter having a plurality of protruding setter posts between second legs of the core and with distal ends supporting first legs of the core; and firing the core in the setter to harden the core. During the firing, the setter posts maintain a predetermined minimum separation between the first legs and the second legs.

In a further embodiment of any of the foregoing embodiments, additionally and/or alternatively, adjacent second legs are connected via core ties.

In a further embodiment of any of the foregoing embodiments, additionally and/or alternatively, the setter posts have a width between adjacent second legs, a height and a length, the length being greater than the width and height.

In a further embodiment of any of the foregoing embodiments, additionally and/or alternatively, the core has: a base; and a plurality of trunks extending from the base. For each of the first legs, one or more of such first legs extend from a given first trunk of the plurality of trunks and one or more of the second legs extend from a given second trunk of the plurality of trunks. In section transverse to lengths of the legs, the setter has an upward concavity from which the setter posts protrude.

In a further embodiment of any of the foregoing embodiments, additionally and/or alternatively, during the firing, the second legs are in contact with the setter between the setter posts while the setter post distal ends support the first legs.

In a further embodiment of any of the foregoing embodiments, additionally and/or alternatively: the first legs have a plurality of bumpers protruding toward associated said second legs and spaced therefrom by respective gaps; and during the firing, the setter posts maintain the predetermined minimum separation between the first legs and the second legs to avoid bumper-to-leg contact.

In a further embodiment of any of the foregoing embodiments, additionally and/or alternatively: the setter posts have a length parallel to the adjacent second leg or legs and a width transverse thereto; and the width is less than the length.

In a further embodiment of any of the foregoing embodiments, additionally and/or alternatively, the setter posts have a height less than the length but greater than the width.

In a further embodiment of any of the foregoing embodiments, additionally and/or alternatively, the length is at least 200% of the width and the height is at least 150% of the width.

In a further embodiment of any of the foregoing embodiments, additionally and/or alternatively, a casting method includes the core firing method and further comprises: assembling the fired core to a second core; over molding the assembled cores with wax to form a pattern; shelling the pattern; de waxing the shelled pattern to form a shell; casting metal in the shell; and deshelling and decoring to leave passageways formed by the core assembly with predetermined wall thicknesses associated with the predetermined spacing.

In a further embodiment of any of the foregoing embodiments, additionally and/or alternatively, the casting method forms an airfoil element and the passageways include main body passageways cast by the second legs and intersecting a camber line of the airfoil of the airfoil element.

In a further embodiment of any of the foregoing embodiments, additionally and/or alternatively, the airfoil element is a blade and the core has: a base; and a plurality of trunks extending from the base. For each of the first legs, one or more of such first legs extend from a given first trunk of the plurality of trunks and one or more of the second legs extend from a given second trunk of the plurality of trunks. The trunks cast trunks of the passageways through a root of the blade.

A further aspect of the disclosure involves, a core setter for firing a core to cast an airfoil element, the airfoil comprising a plurality of main body passageways intersecting a camber line of the airfoil and a plurality of skin passageways between main body passageways and a surface of the airfoil. The core setter comprises: first means for supporting a plurality of skincore legs; and second means for holding a plurality of main body core legs spaced apart from the skincore legs.

In a further embodiment of any of the foregoing embodiments, additionally and/or alternatively, the second means comprises a plurality of protrusions for extending between an adjacent two said skincore legs and contacting an associated one of said main body core legs.

In a further embodiment of any of the foregoing embodiments, additionally and/or alternatively, the first means and the second means are in a single piece.

A further aspect of the disclosure involves, a method for using the core setter, the method comprising: placing into the core setter a core piece forming the plurality of skincore legs and the plurality of main body core legs; and heating the core setter and the core piece.

A further aspect of the disclosure involves, a core setter for firing a core to cast an airfoil element, the airfoil comprising a plurality of main body passageways intersecting a camber line of the airfoil and a plurality of skin passageways between main body passageways and a surface of the airfoil. The core setter comprises: a concave surface; and a plurality of protrusions extending from the concave surface.

In a further embodiment of any of the foregoing embodiments, additionally and/or alternatively, the protrusions have a length and a width and the width is less than the length.

In a further embodiment of any of the foregoing embodiments, additionally and/or alternatively, the length is within 20° of a local axis of the concavity.

In a further embodiment of any of the foregoing embodiments, additionally and/or alternatively, the concave surface and the protrusions are part of a single piece.

The features of the embodiments above may be combined in any combination unless expressly indicated otherwise or technically infeasible.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 7:
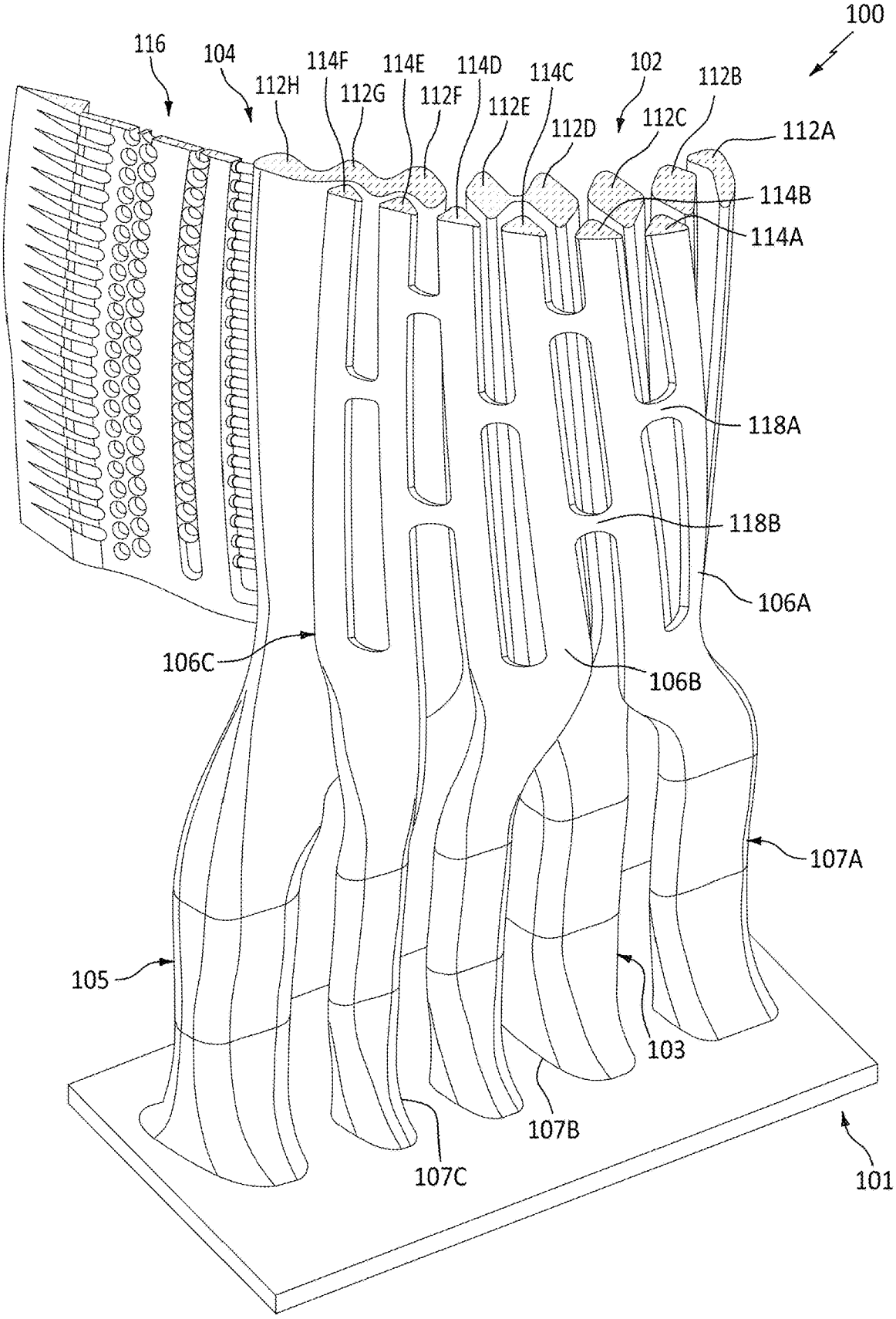
FIG. 7 is a cutaway view of a core main piece.
Figure 9:
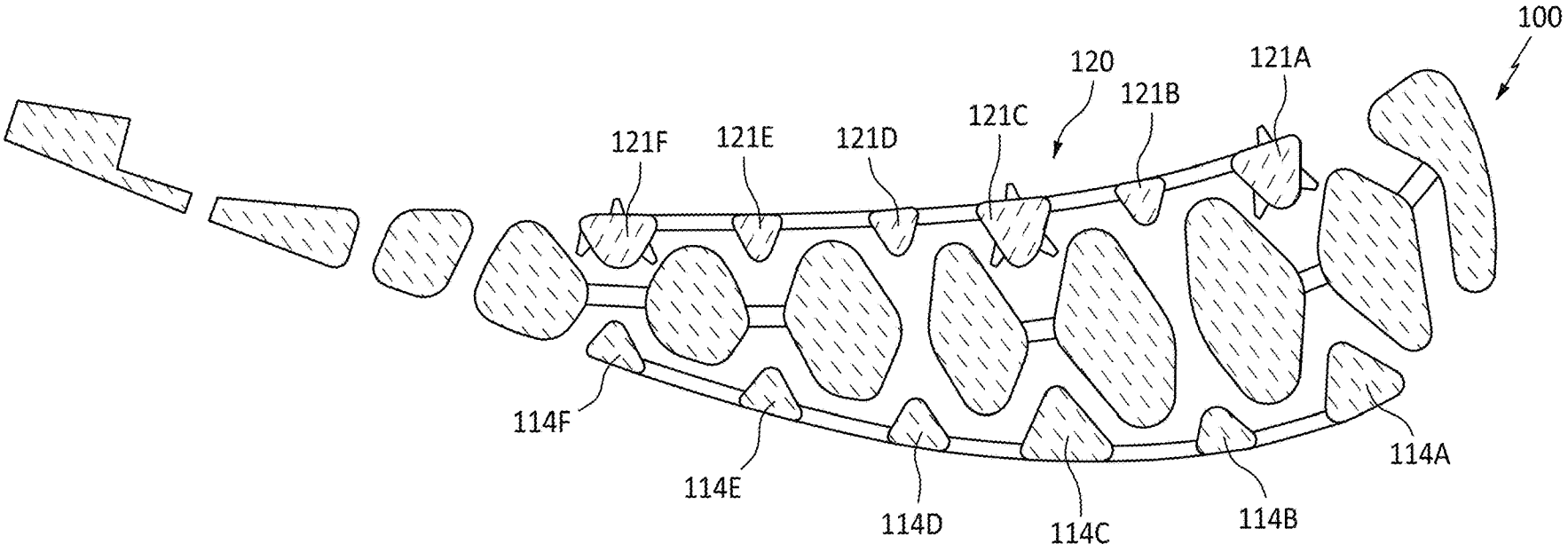
FIG. 9 is a sectional view of a core assembly including the main piece of FIG. 7 and a pressure side skincore.
Figure 10:
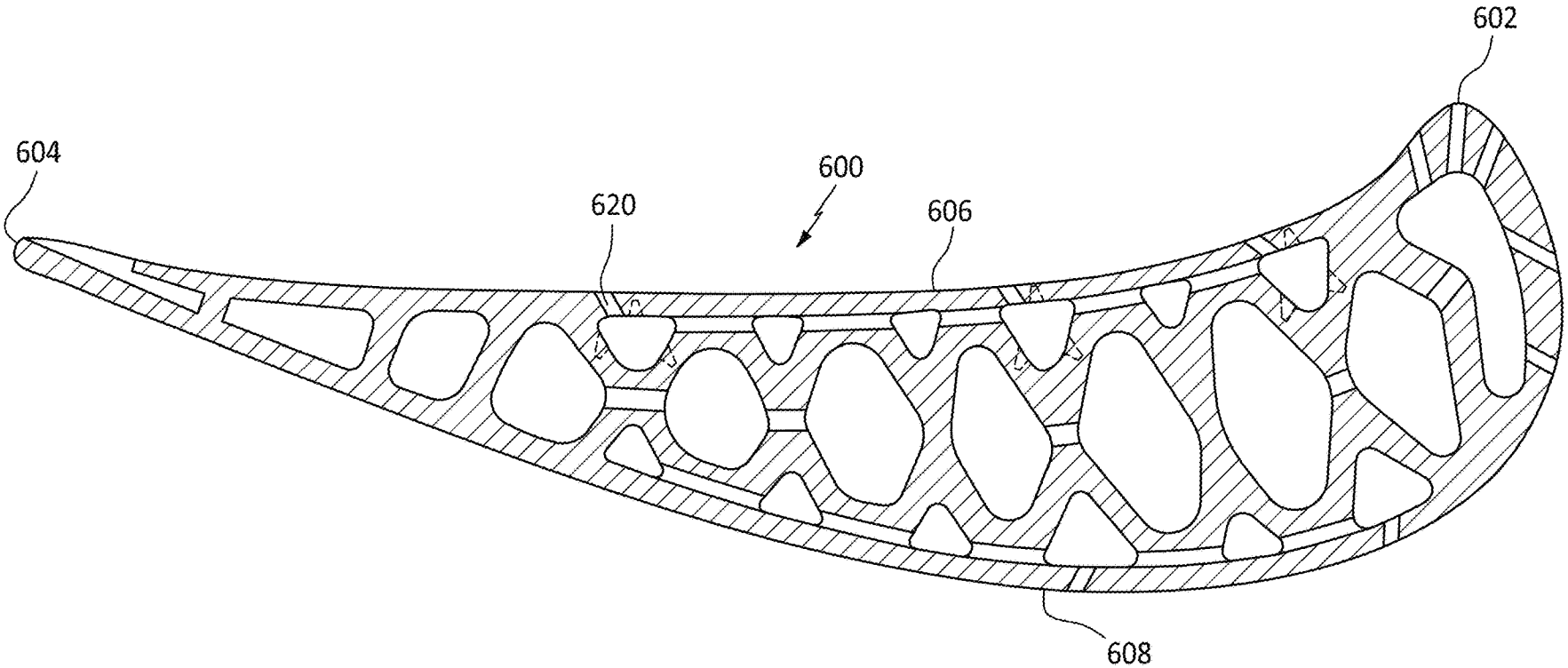
FIG. 10 is a sectional view of a cast airfoil.

FIG. 7 shows a single ceramic core piece 100 having sections 102, 104, and 106A-106C forming main spanwise body legs 112A-112H (for casting main body passageways in a blade) and suction side skin legs 114A-114F (for casting suction side skin passageways). A second core (120 (FIG. 9)) will ultimately be assembled to this core and have pressure side legs 121A-F for casting the pressure side skin passageways (and may have trunk portions, not shown, for casting trunks to feed such skin passageways). The example core piece 100 is shown cut away prior to reaching a blade tip region where there may be inter-connections between spanwise legs/segments. FIG. 10 shows an example cross-section of an airfoil 600 (of a blade or vane) with a leading edge 602, trailing edge 604, pressure side 606, and suction side 608 and passageways cast by the core assembly. Example film cooling outlets 620 are drilled post-casting.

Each of the sections 102, 104, and 106A-106C includes spanwise legs (for casting spanwise passageway legs) extending from one or more trunks 103, 105, 107A-107C (for casting passageway trunks to feed the associated legs from respective inlets in the blade root inner diameter (ID) surface). Thus, the example core has: a leading main body section 102 with a trunk 103 and spanwise legs 112A-112E; and a trailing main body section 104 having a trunk 105, spanwise legs 112F-112H, and a discharge slot section 116. The core piece 100 also has: a leading suction side section 106A with a trunk 107A and a pair of spanwise legs 114A, 114B; an intermediate suction side section 106B with a trunk 107B and a pair of legs 114C, 114D; and a trailing suction side section 106C with a trunk 107C and pair of legs 114E, 114F. The trunks may all extend from a single shared baseplate 101 or block of the piece. This guarantees precise trunk alignment and ease of handling. The various adjacent legs of each skin core section 106A-106C and the adjacent legs of respective adjacent skin core sections may be linked by core ties 118A, 118B (intra-section ties 118A and inter-section ties 118B, respectively). The core ties provide for precise positioning of skin core legs relative to each other.

An example core manufacture process comprises molding and firing. The molding may use elastomeric/flexible molds. If such flexible molds are used instead of a metallic mold, some backlocking may be accommodated by mold flexing/stretching when releasing the green ceramic.

Figure 1:
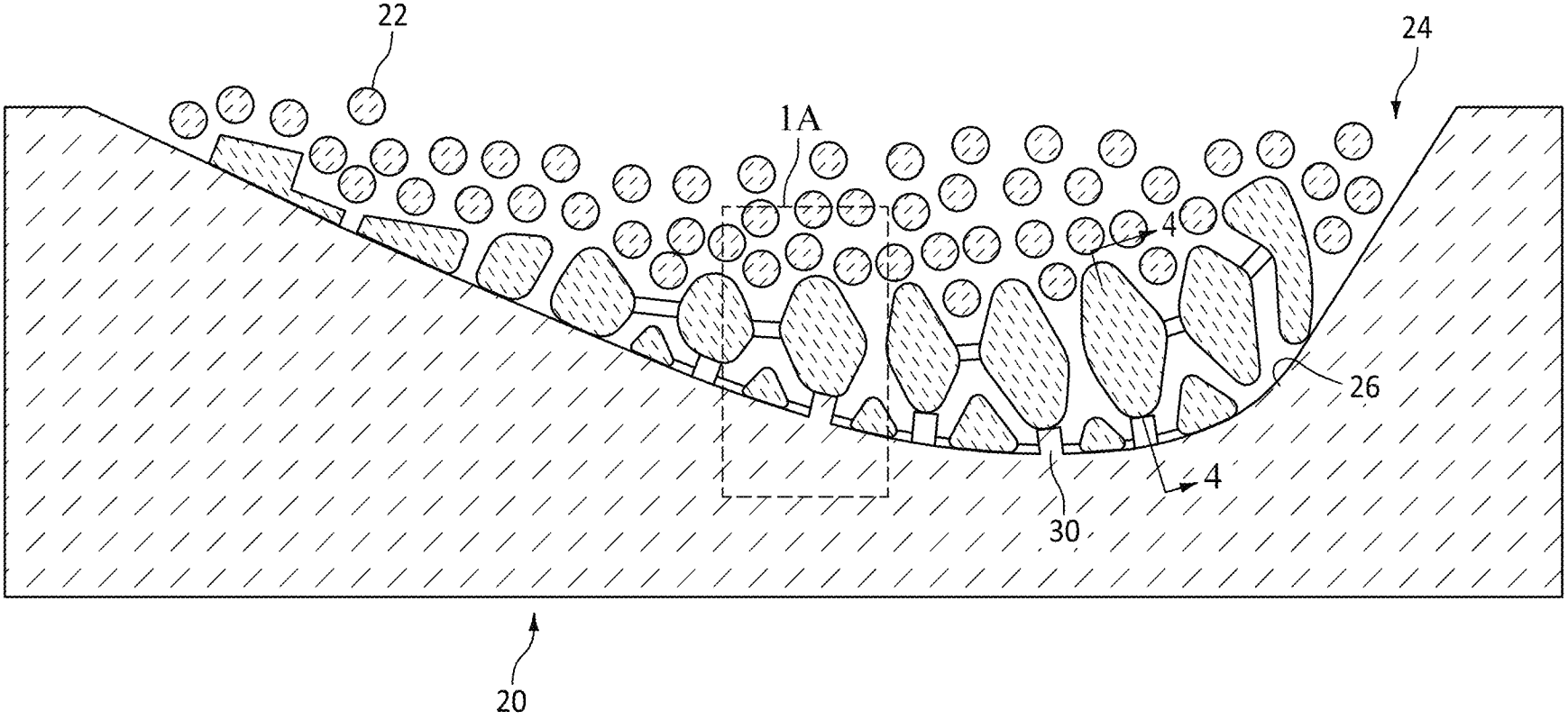
FIG. 1 is a transverse sectional view of a core setter having support posts.

Firing is in a furnace with the core held by a setter. FIG. 1 shows such a core in a setter lower half (bottom or base) 20, held down by media 22 such as ceramic beads (schematically shown not contacting for purpose of illustration) made from materials such as silica or alumina. The setter bottom has an upwardly-open compartment 24 with a generally concave (in streamwise section relative to the ultimate airfoil) surface 26. Spacing between the main body legs and the adjacent skin core legs determines ultimate thickness of cast airfoil internal walls between the associated main body passageways and skin passageways. Accordingly, precise registry is desirable. FIG. 1 shows the setter bottom having a plurality of posts 30 positioned streamwise between adjacent skin core legs to contact respective associated main body core legs. The example posts may be unitarily formed with the substantial remainder of the setter bottom such as via molding and firing. If the setter and posts are made from a die, the sides of the posts may be drafted at an angle and the posts aligned in a pull direction to be able to remove the setter from the die. Example setter bottom materials are alumina and silica. Example setter manufacture techniques may be similar to core manufacture techniques (e.g., molding and firing of ceramic).

Figure 8:
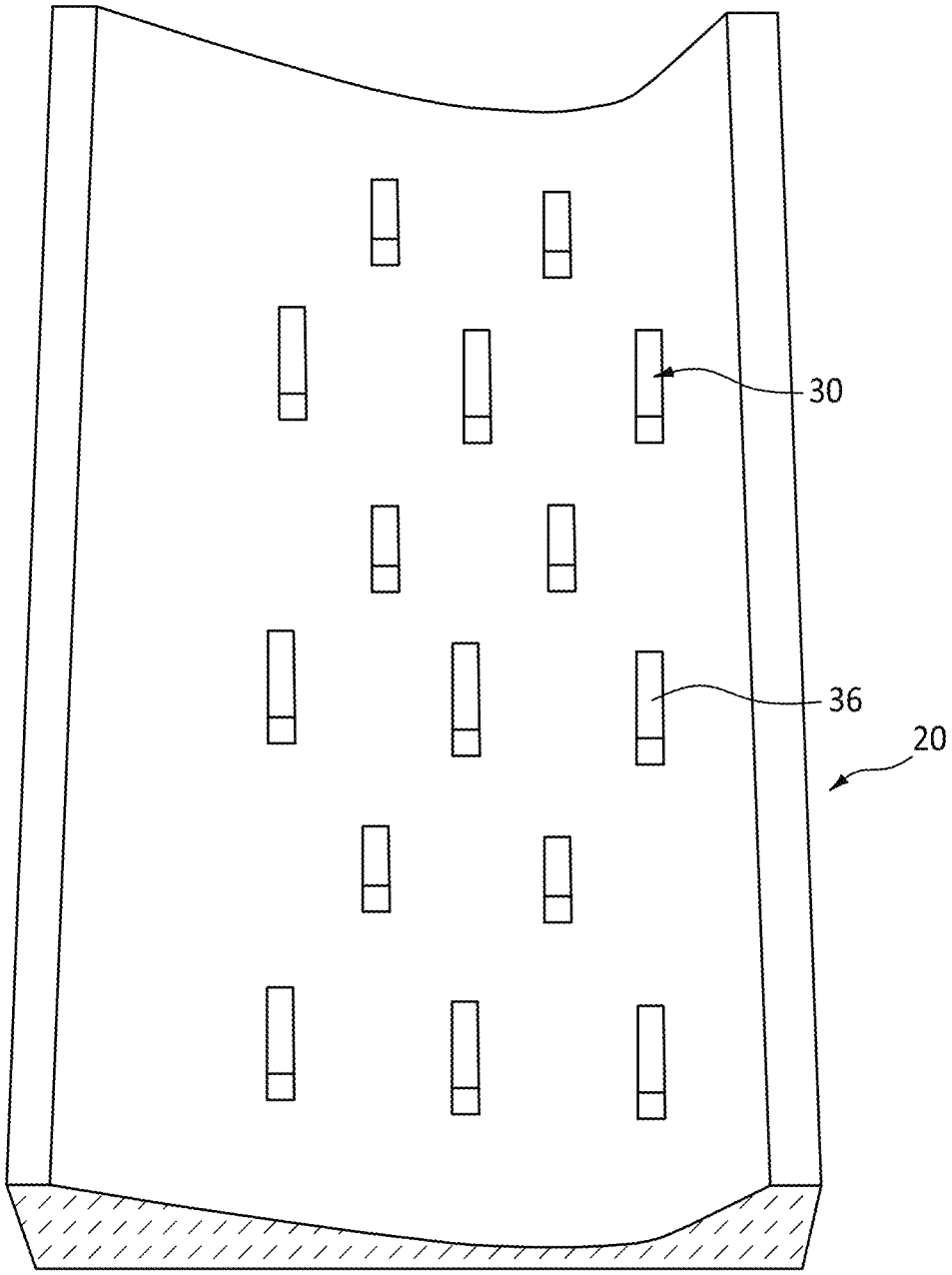
FIG. 8 is a cutaway view of the setter.

FIG. 8 schematically shows a spanwise and streamwise distribution of posts in a concavity of the setter lower piece (shown cut away near ends of the airfoil).

Figure 2:
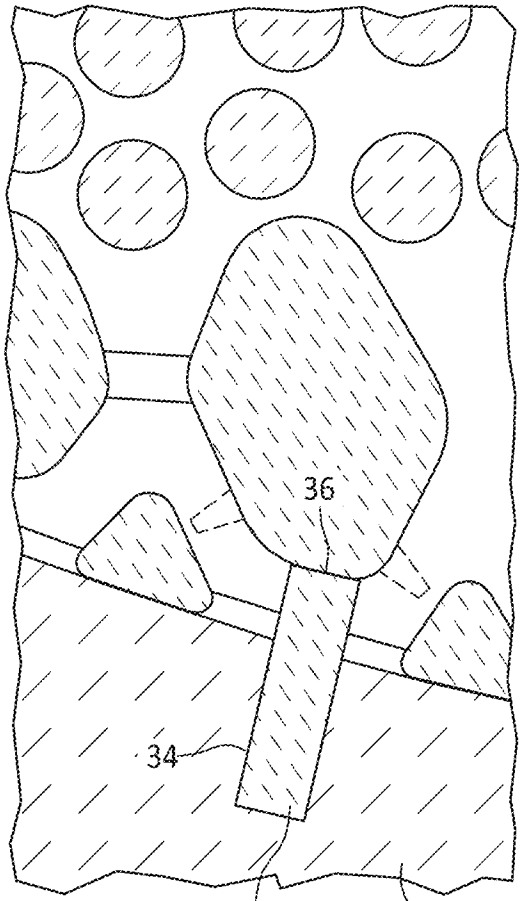
FIG. 2 is a similarly enlarged/detail enlarged view of an alternate core setter.

Alternatively, the posts may be separate pieces 32 (FIG. 2) installed in sockets 34 in a main setter bottom piece 20A. The sockets may be drilled or may be molded in place and the separate posts may be inserted and secured via ceramic adhesive prior to a firing of the setter. The posts 30 may be post-machined for a specific height profile. The posts 32 may be pre-machined or post-machined for a specific height profile. By having separate pieces for the posts, they can be replaced more easily with longer or shorter ones to adjust the height as needed in order to achieve the desired gap. Example, replacement may involve extraction and/or drilling. Moreover, separate posts could be added to a setter that already contains unitarily formed posts to provide additional support as needed (e.g., after drilling holes for the added posts). The post distal ends 36 thus, ultimately, contact the associated main body core legs to maintain a precise position. The separate posts could be made from the same material as the setter, such as alumina or silica. For round posts, alumina rods are readily available.

Figure 4:
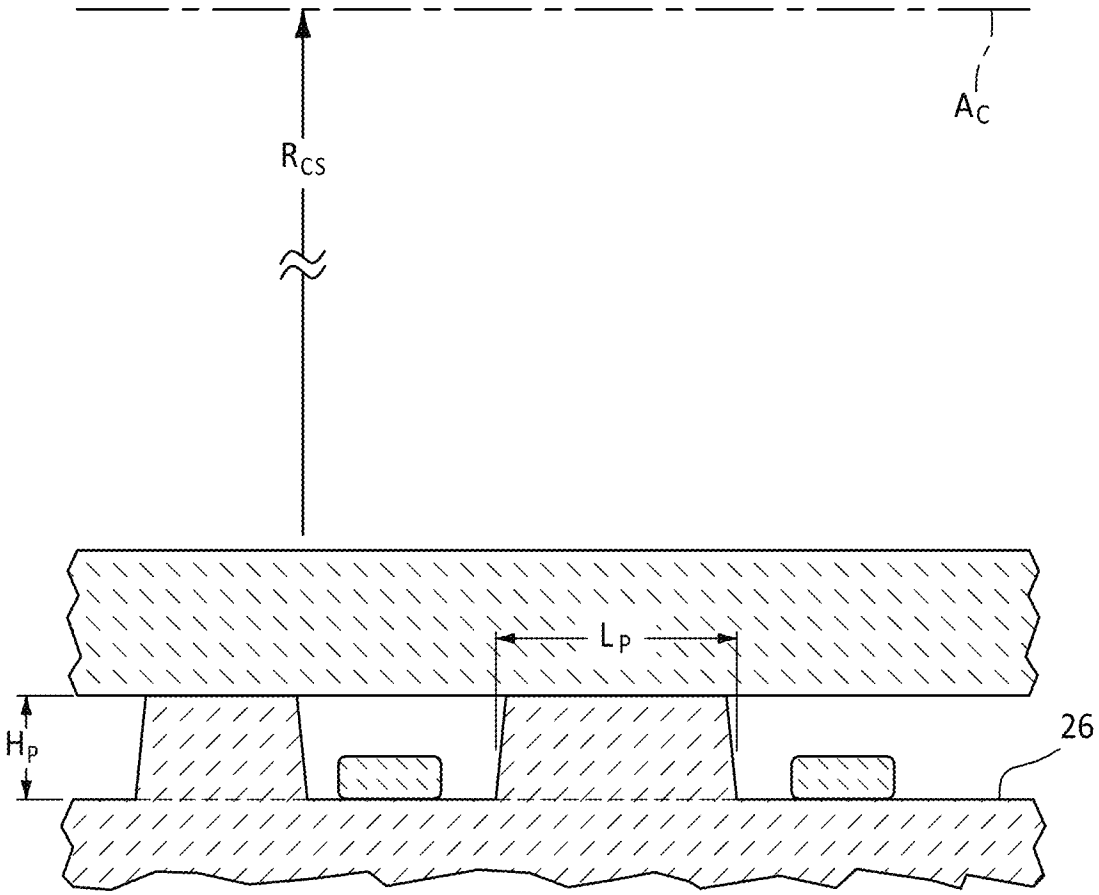
FIG. 4 is a sectional view of the setter of FIG. 1, taken along line 4-4.

FIG. 4 shows how the setter posts may protrude between spanwise-spaced core ties. In the illustrated example, a post is between an adjacent pair of core ties. However, others may be adjacent only one core tie. The streamwise width $W_P$ (FIG. 1A) of the post is limited by the available space between adjacent skin core legs. The spanwise extent $L_P$ (FIG. 4) of the post is limited by the position of skin core ties. Thus, the spanwise dimension of the post may be much greater than the streamwise dimension so that the post has a wall or fin-like quality with a length $L_P$ along the gap between skin core legs being substantially greater than a width $W_P$ between them (e.g., such length may be at least twice the width or an example 200% to 500% of the width). Alternatively, the post may be cylindrical in shape such that the length $L_P$ and the width $W_P$ are the same. FIG. 4 also shows a post height $H_P$. The post height is selected to provide nominal separation(s) $H_{G1}$ between the associated main body leg on the one hand and the adjacent skin leg(s) on the other hand. The particular selection, in view of manufacturing and other tolerances, may be to maintain during firing a predetermined minimum separation between the main body legs and the skin legs. The example height is 150% to 300% of the width. FIG. 4 also shows a local axis of curvature $A_C$ of the concavity and a radius of curvature of $R_{CS}$. The length vector of the posts is within 20° of the axis of curvature $A_C$. The height of the posts may extend in a direction parallel to a setter pull direction. Alternatively, the height of the posts may extend in a direction closer to the concave surface normal or any angle between the pull direction and concave surface normal, so long as the post is able to clear the gap between adjacent skin core legs during core insertion and removal from the setter.

Figure 3:
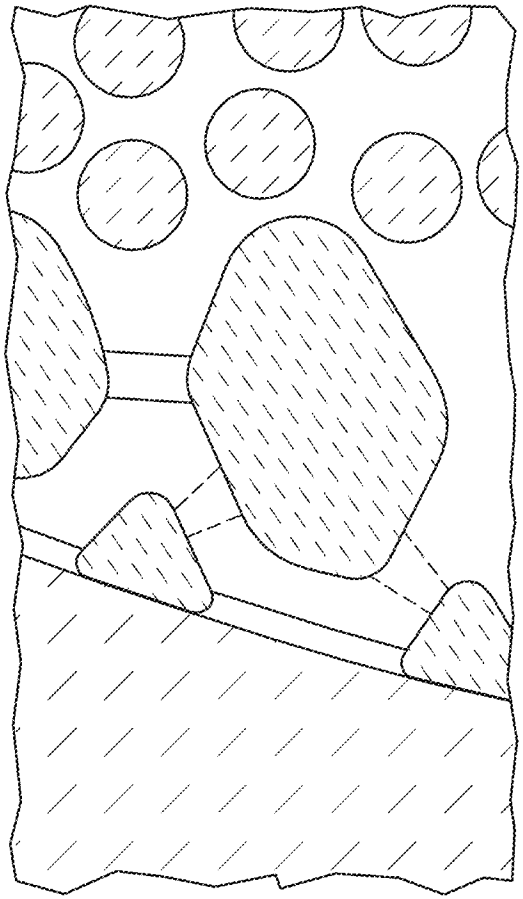
FIG. 3 (PRIOR ART)
FIG. 3 is a similarly enlarged/detail enlarged view of a prior art core setter.
Figure 1A:
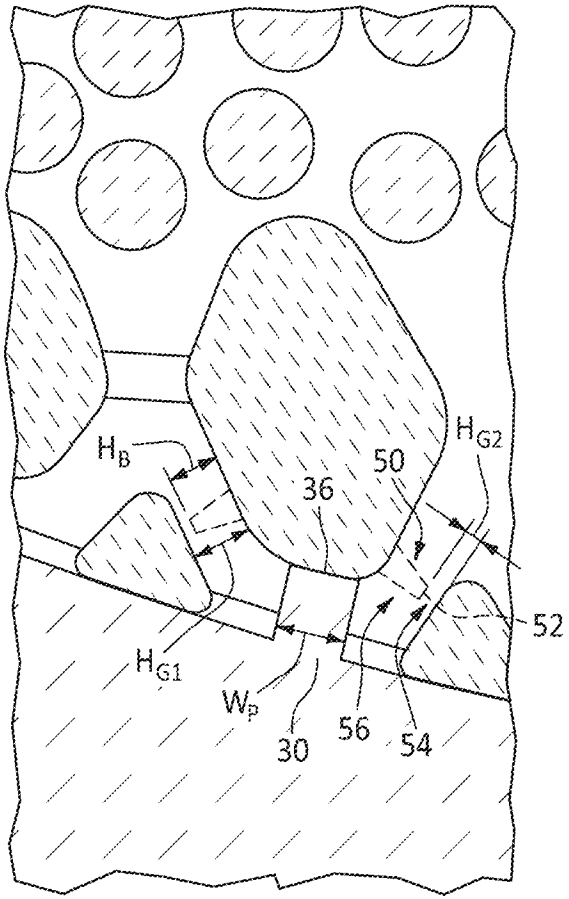
FIG. 1A is an enlarged/detail view of a portion of the setter having optional core bumpers on a main body core.

As a further option, the cores may be pre-molded with protruding bumpers 50 (FIG. 1A of height $H_B$). Advantageously, the bumpers do not contact during core firing (contra prior art of FIG. 3), but their distal tips 52 remain closely spaced from adjacent legs. In this example, the bumpers protrude from the main body core legs toward respective faces of the associated suction side core legs. A particular embodiment involves rounded-corner triangular section skin core legs with a flat side generally parallel to the associated external wall surface of the airfoil to form the internal surface thereof. Adjacent skin core legs thus inter-nest depthwise with adjacent main body core legs. The example main body core legs (or most such as 112B-112H) are generally rounded-corner quadrilateral in section with corners of the quadrilateral inter-nesting with an adjacent pair of skin core legs. Respective bumpers protrude from each face toward distal ends adjacent to sides of the skin core legs. These bumpers may serve to maintain spacing in other stages of the process such as during wax injection for pattern forming and the ultimate metal casting. Ideally, the bumpers never contact (having a nominal gap 54 of height $H_{G2}$ out of a much larger leg-to-leg gap 56 of height $H_{G1}$) but as a practical matter, they have a contingent function of contacting to maintain acceptable spacing in limited circumstances to improve performance uniformity and reduce scrappage. Example $H_{G2}$ is 0.050 millimeter to 0.20 millimeter, more particularly, 0.10 millimeter to 0.15 millimeter.

Figure 5:
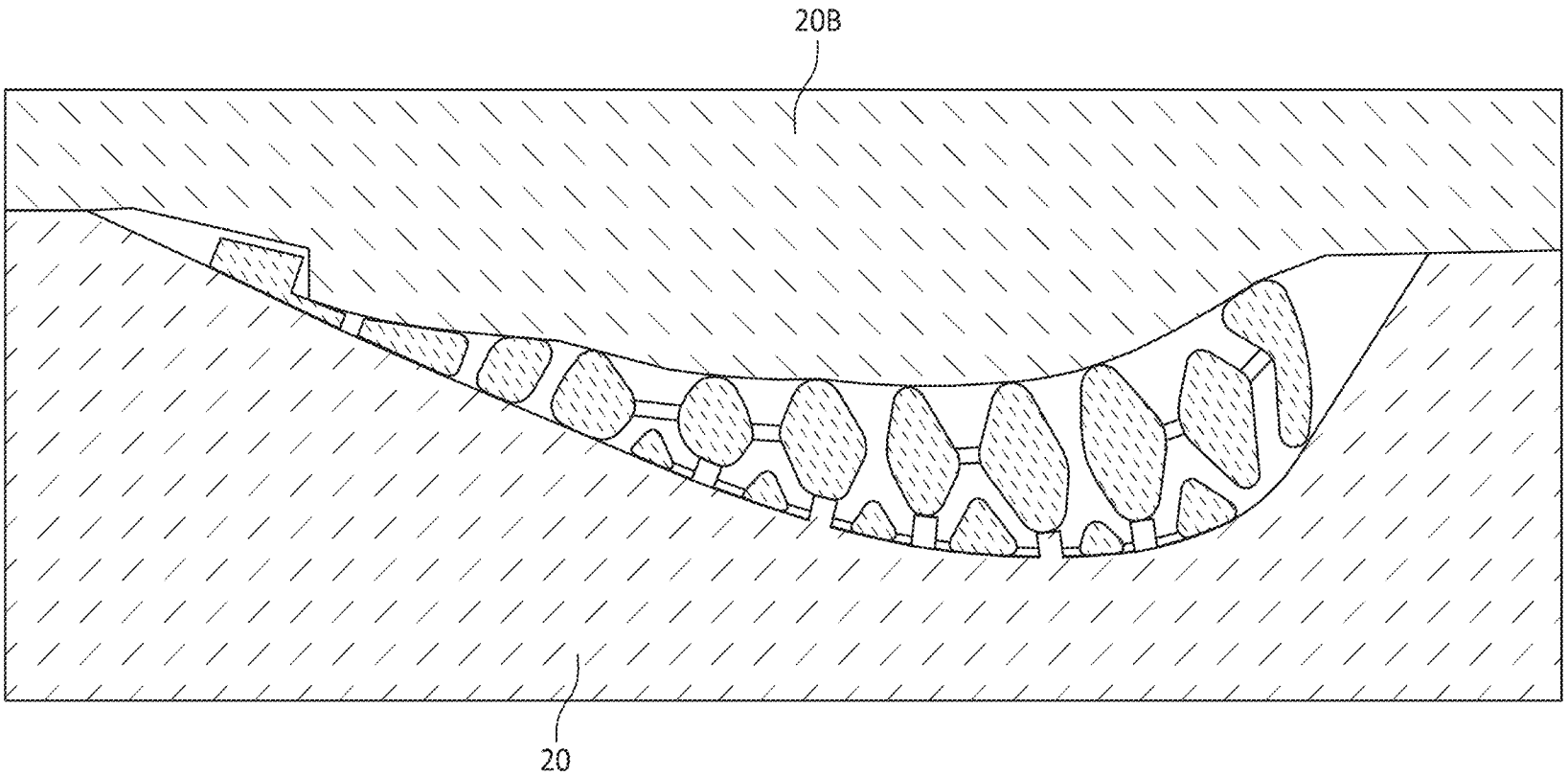
FIG. 5 is a transverse sectional view of an alternate setter.

FIG. 5 shows an alternative example wherein the core is held down by a top half 20B of the mold setter.

Figure 6:
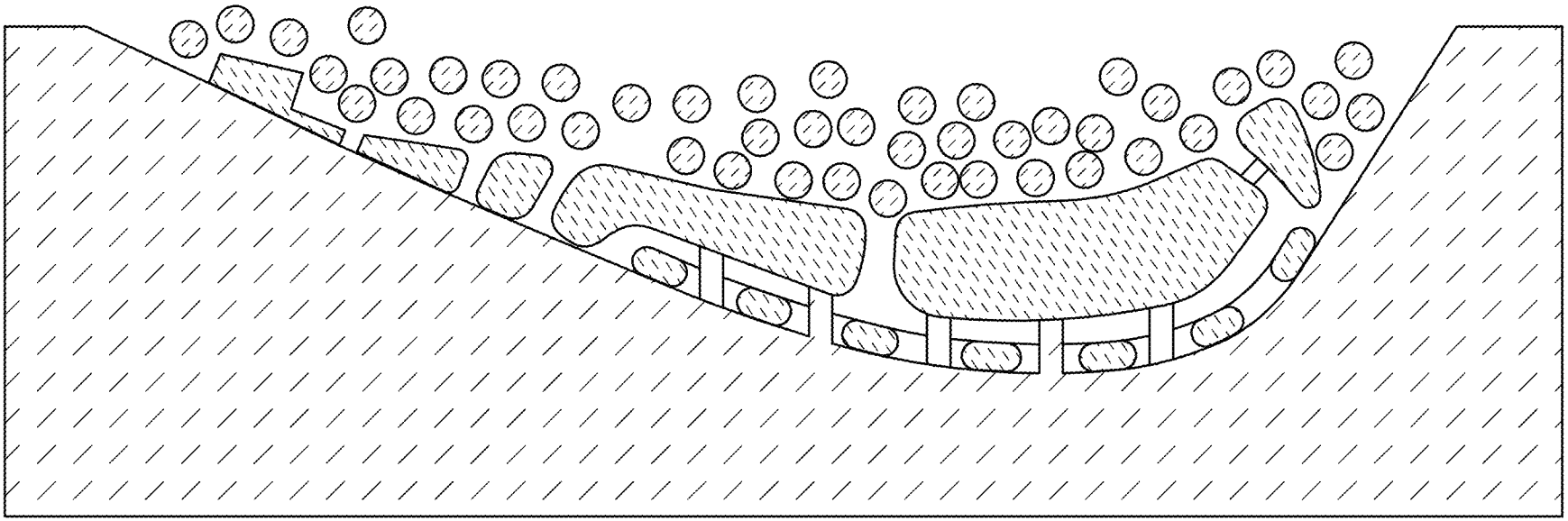
FIG. 6 is a transverse sectional view of another alternate setter.

FIG. 6 shows an alternative example wherein the cross-sectional shapes of the legs are different and do not depthwise nest. In this example, the skin core legs are generally obround in cross-section and the main body passageways are larger and less broken up by walls between pressure side and suction side. Such a configuration may be more relevant to vanes which are subject to lesser dynamic loading and, therefore, they forego some of the wall structure. As with the other illustrated embodiments, this example of a main core piece would be assembled to one or more pressure side core pieces. The pressure side core piece or piece combination may have of similar cross-section to those on the suction side. Nevertheless, it may be possible to simply extend the main body core legs and associated passageway legs toward the pressure side and avoid pressure side skin passageways.

Although it may be tempting to include pressure side core sections in the single piece, this has disadvantages. The media 22 or a top core setter piece 20B cannot similarly hold the pressure side core legs spaced from the main body core legs. And it is impractical to attempt to route the posts all the way through the main body core section from the suction side. Thus, relative mounting and positioning of the pressure side core piece (s) and main core piece may be by conventional bumpers. FIG. 6 shows such bumpers on the suction side.

In use, the core piece may be assembled to one or more other pieces (if any). In addition to the aforementioned pressure side piece(s), other pieces may include ceramic or refractory metal discharge/outlet cores. Assembly may be via adhesive (e.g., ceramic) and/or pre-formed sacrificial spacers (e.g., wax) or in-situ formed (e.g., wax welding). After such assembly of the core piece(s), the core or core assembly may be placed in a wax molding die for molding sacrificial pattern material (wax) over the core or assembly (or the assembly may be performed partially in the die and the die then closed over the assembly). The wax molding die parts may have small compartments for partially receiving the portions (e.g., terminal end portions) of the core or assembly.

Wax is injected to fill spaces within/around the core or assembly and, upon hardening of the wax, the resulting pattern may be released from the die.

The resulting wax-overmolded core or assembly may then be ceramic stucco shelled to form a shell. The shell may be dewaxed (e.g. steam autoclave) and may be fired to harden (alternatively fire may occur during casting). The dewaxed shell now has a void corresponding to the ultimate raw casting and molten alloy may be poured into the shell to form the casting. The shelling may capture the exposed terminal end portions in shell material.

After the cast alloy cools and solidifies, the casting may be deshelled (e.g., mechanical breaking of the shell) and decored (e.g., thermo-oxidative decoring and/or chemical leaching (e.g., alkaline and/or acid leaching)). And there may be machining (e.g., at least to de-gate, but also including finish machining of key contours such as the root of a blade).

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for firing a ceramic core, the method comprising:

placing the core in a setter, the setter having a plurality of protruding setter posts between second legs of the core and with distal ends supporting first legs of the core; and firing the core in the setter to harden the core, wherein, during the firing, the setter posts maintain a predetermined minimum separation between the first legs and the second legs, wherein:

the first legs have a plurality of bumpers protruding toward associated said second legs and spaced therefrom by respective gaps; and during the firing, the setter posts maintain the predetermined minimum separation between the first legs and the second legs to avoid bumper-to-leg contact.

2. The method of claim 1 wherein:

adjacent second legs are connected via core ties.

3. The method of claim 1 wherein:

the setter posts have a width between adjacent second legs, a height and a length, the length being greater than the width and height.

4. The method of claim 1 wherein the core has:

a base; and a plurality of trunks extending from the base, wherein:

for each of the first legs, one or more of such first legs extend from a given first trunk of the plurality of trunks and one or more of the second legs extend from a given second trunk of the plurality of trunks; and in section transverse to lengths of the legs, the setter has an upward concavity from which the setter posts protrude.

5. The method of claim 1 wherein:

during the firing, the second legs are in contact with the setter between the setter posts while the setter post distal ends support the first legs.

6. The method of claim 1 wherein:

the setter posts have a length parallel to the adjacent second leg or legs and a width transverse thereto; and the width is less than the length.

7. The method of claim 6 wherein:

the setter posts have a height less than the length but greater than the width.

8. The method of claim 7 wherein:

the length is at least 200% of the width; and the height is at least 150% of the width.

9. A casting method including the core firing method of claim 1 and further comprising:

assembling the fired core to a second core;

over molding the assembled cores with wax to form a pattern;

shelling the pattern;

de-waxing the shelled pattern to form a shell;

casting metal in the shell; and deshelling and decoring to leave passageways formed by the core assembly with predetermined wall thicknesses associated with the predetermined spacing.

10. The casting method of claim 9 wherein:

the casting method forms an airfoil element; and the passageways include main body passageways cast by the second legs and intersecting a camber line of the airfoil of the airfoil element.

11. The casting method of claim 10 wherein the airfoil element is a blade and the core has:

a base; and a plurality of trunks extending from the base, wherein:

for each of the first legs, one or more of such first legs extend from a given first trunk of the plurality of trunks and one or more of the second legs extend from a given second trunk of the plurality of trunks; and the trunks cast trunks of the passageways through a root of the blade.

12. A method for firing a ceramic core, the method comprising:

placing the core in a setter, the setter having a plurality of protruding setter posts between second legs of the core and with distal ends supporting first legs of the core; and firing the core in the setter to harden the core, wherein, during the firing, the setter posts maintain a predetermined minimum separation between the first legs and the second legs, wherein:

the core has:

a base; and a plurality of trunks extending from the base; and for each of the first legs, one or more of such first legs extend from a given first trunk of the plurality of trunks and one or more of the second legs extend from a given second trunk of the plurality of trunks.

13. The method of claim 12 wherein:

in section transverse to lengths of the legs, the setter has an upward concavity from which the setter posts protrude.

14. The method of claim 12 wherein:

adjacent second legs are connected via core ties.

15. The method of claim 12 wherein:

the setter posts have a width between adjacent second legs, a height and a length, the length being greater than the width and height.

16. The method of claim 12 wherein:

during the firing, the second legs are in contact with the setter between the setter posts while the setter post distal ends support the first legs.

17. The method of claim 12 wherein:

the setter posts have a length parallel to the adjacent second leg or legs and a width transverse thereto;

the width is less than the length;

the setter posts have a height less than the length but greater than the width;

the length is at least 200% of the width; and the height is at least 150% of the width.

18. A casting method including the core firing method of claim 12 further comprising:

assembling the fired core to a second core;

over molding the assembled cores with wax to form a pattern;

shelling the pattern;

de-waxing the shelled pattern to form a shell;

casting metal in the shell; and deshelling and decoring to leave passageways formed by the core assembly with predetermined wall thicknesses associated with the predetermined spacing.

19. The casting method of claim 18 wherein:

the casting method forms an airfoil element; and the passageways include main body passageways cast by the second legs and intersecting a camber line of the airfoil of the airfoil element.

20. The casting method of claim 18 wherein:

the airfoil element is a blade; and the trunks cast trunks of the passageways through a root of the blade.

* * * * *